US007997770B1

(12) United States Patent
Meurer

(10) Patent No.: US 7,997,770 B1
(45) Date of Patent: Aug. 16, 2011

(54) LED TUBE REUSABLE END CAP

(76) Inventor: William Henry Meurer, Pasadena, CA (US)

( * ) Notice: Subject to any disclaimer, the term of this patent is extended or adjusted under 35 U.S.C. 154(b) by 55 days.

(21) Appl. No.: 12/378,413

(22) Filed: Feb. 12, 2009

(51) Int. Cl.
*F21V 3/00* (2006.01)
*F21V 5/00* (2006.01)

(52) U.S. Cl. ..... 362/311.02; 362/555; 362/171; 362/222

(58) Field of Classification Search ..... 362/551, 362/555, 559, 102, 171, 172, 178, 222, 223, 362/224, 657, 658, 659, 311.02
See application file for complete search history.

(56) References Cited

U.S. PATENT DOCUMENTS

| | | | | |
|---|---|---|---|---|
| 6,238,612 | B1 * | 5/2001 | Allan et al. | 264/325 |
| 6,583,550 | B2 | 6/2003 | Iwasa et al. | |
| 6,860,628 | B2 | 3/2005 | Robertson et al. | |
| 6,936,968 | B2 | 8/2005 | Cross et al. | |
| 6,997,576 | B1 | 2/2006 | Lodhie et al. | |
| 7,114,830 | B2 | 10/2006 | Robertson et al. | |
| 7,114,834 | B2 | 10/2006 | Rivas et al. | |
| 7,249,865 | B2 | 7/2007 | Robertson | |
| 7,307,391 | B2 | 12/2007 | Shan | |
| 7,438,441 | B2 | 10/2008 | Sun et al. | |
| 7,441,922 | B2 | 10/2008 | Huang et al. | |
| 7,476,004 | B2 * | 1/2009 | Chan | 362/240 |
| 7,478,924 | B2 | 1/2009 | Robertson | |
| 7,502,171 | B2 * | 3/2009 | Morooka et al. | 359/676 |
| 2002/0060526 | A1 | 5/2002 | Timmermans et al. | |
| 2004/0062041 | A1 | 4/2004 | Cross et al. | |
| 2006/0126325 | A1 * | 6/2006 | Lefebvre et al. | 362/217 |
| 2008/0037245 | A1 | 2/2008 | Chan | |
| 2008/0151535 | A1 * | 6/2008 | de Castris | 362/220 |
| 2008/0158870 | A1 | 7/2008 | Sun et al. | |
| 2010/0033964 | A1 * | 2/2010 | Choi et al. | 362/234 |

* cited by examiner

*Primary Examiner* — Anabel Ton
*Assistant Examiner* — Danielle Allen
(74) *Attorney, Agent, or Firm* — Gene Scott; Patent Law & Venture Group

(57) ABSTRACT

A replacement for the standard fluorescent lamp tube has a plurality of LED devices mounted on a circuit board. The enclosure within which the circuit board is held has a clear or frosted lens mounted on a heat sink. The lens and heat sink each are arcuately shaped and together form a circular tube. A power converter is mounted below the circuit board and transfers its heat to the heat sink. A pair of pins mounted on the power converter extend beyond one end of the tube. An end cap has means for snapping onto and off the end of the tube and has clearance holes for the pins to protrude through and extend beyond so as to be fitting into mechanical and electrical contact with a standard lamp mounting fixture.

3 Claims, 4 Drawing Sheets

LED TUBE REUSABLE END CAP

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to tubular lighting devices such as fluorescent lamps, and more particular to a replacement for fluorescent lamps having LED illumination and a replaceable and reusable end cap.

2. Description of Related Art including information disclosed under 37 CFR 1.97 and 1.98

Sun et al., US 2008/0158870 discloses that a Light Emitting Diode (LED) light tube is applied to be directly inserted into two pairs of electrode insertion holes of a fluorescent light tube fixture to replace a fluorescent tube. The LED light tube comprises a heat-dissipating base, a plurality of linear-extend LEDs and a light-transmissible shell, wherein an arrangement surface of the heat-dissipating base is arranged with the linear-extend LEDs, a peripheral surface of the heat-dissipating base is formed with a plurality of heat-dissipating grooves, two end-surfaces of the heat-dissipating base are respectively connected a pairs of electrodes to be inserted into the electrode insertion holes, and the light-transmissible shell including an opening for covering and assembling to the arrangement surface to package the linear-extend LEDs with the heat-dissipating base.

Chan, US 2008/0037245 discloses that an LED lighting lamp tube comprises a transparent tube body, lamp caps, electrode pins, pedestals mounted at the connection position of the transparent tube body and the lamp caps, a power supply converter located adjacent to the lamp caps and inside the tube body, a PCB and a plurality of LED mounted on the PCB. These LED are connected in parallel or in series, and a light-scattering plate may be disposed over these LED. A plurality of LED chips can be directly mounted on the light-scattering plate. The lamp caps and the electrode pins possess the same international standards as common lamp tubes.

Cross et al., US 2004/0062041 discloses that an LED light tube for replacement of fluorescent light tubes includes an elongated cylindrical transparent envelope, a base cap at each end of the envelope, and at least one LED device in electrical communication with the base cap. The LED light tube is adapted for use in troffer light fixtures.

Timmermans et al., US 2002/0060526 discloses that the present invention provides a light tube for illumination by a power supply circuit including a bulb portion and a pair of end caps disposed at opposite ends of the bulb portion. A plurality of light emitting diodes are disposed inside the bulb portion and in electrical communication with the pair of end caps for illuminating in response to electrical current to be received from the power supply circuit.

Robertson, U.S. Pat. No. 7,478,924 discloses that LEDs can be added to a conventional fluorescent lighting fixture by providing an LED circuit to the fluorescent lighting fixture pan, by adding LEDs to the fluorescent light tube with an indentation in the light tube rear to receive an LED to influence the apparent color of the fluorescent light, or by adding an LED to either end cap of the fluorescent light tube to shine down the tube from the interior, added as an add-on band which could clip onto the tube, and could also include a circuit board based LED attached to the rear of the tube and alternatively have LED lighting within a charged fluorescent tube.

Huang et al., U.S. Pat. No. 7,441,922 discloses that an LED lamp tube includes a tube that admits light, circuit boards respectively mounted inside the tube, each circuit board carrying an array of LEDs, two end caps respectively capped on the ends of the tube to hold the circuit boards inside the tube and connectable to connectors of a conventional fluorescent bulb holder to secure the tube to the conventional fluorescent bulb holder, and a power cord extending from the circuit boards out of the tube for connection to power supply to obtain the necessary working voltage for the LEDs.

Sun et al., U.S. Pat. No. 7,438,441 discloses that a Light Emitting Diode (LED) light tube is applied to be directly inserted to two pairs of electrode insertion holes of a fluorescent light tube fixture to replace a fluorescent tube. The LED light tube comprises a heat-dissipating base, a plurality of linear-extend LEDs and a light-transmissible shell, wherein an arrangement surface of the heat-dissipating base is arranged with the linear-extend LEDs, a peripheral surface of the heat-dissipating base is formed with a plurality of heat-dissipating grooves, two end-surfaces of the heat-dissipating base are respectively connected a pairs of electrodes to be inserted into the electrode insertion holes, and the light-transmissible shell including an opening for covering and assembling to the arrangement surface to package the linear-extend LEDs with the heat-dissipating base.

Shan, U.S. Pat. No. 7,307,391 discloses that a light emitting diode lighting device and system that can be used for illuminating the interior and/or exterior of vehicles, aircraft, watercraft, signage or buildings is provided. It includes a voltage feedback constant current power supply circuitry and high power LEDs. The printed circuit assemblies are firmly mounted onto a continuous or semi-continuous mounting channel case that also works as a heat sink. By this means, it not only increases the reliability of the LED lighting tube but also it provides sufficient heat dissipation capability for the heat generated by the LEDs. Since the operating temperature of the LEDs is controlled and stays in cool condition, it dramatically increases the LED's lifetime and efficiency. The end caps of this LED lighting device are fully compatible with existing conventional fluorescent light fixtures and can directly replace those fluorescent lighting tubes in vehicles, mass-transit, watercrafts, aircrafts, signage or buildings with minimal modifications.

Robertson, U.S. Pat. No. 7,249,865 discloses that LEDs can be added to a conventional fluorescent lighting fixture by providing an LED circuit to the fluorescent lighting fixture pan, by adding LEDs to the fluorescent light tube with an indentation in the light tube rear to receive an LED to influence the apparent color of the fluorescent light, or by adding an LED to either end cap of the fluorescent light tube to shine down the tube from the interior, added as an add-on band which could clip onto the tube, and could also include a circuit board based LED attached to the rear of the tube and alternatively have LED lighting within a charged fluorescent tube.

Rivas et al., U.S. Pat. No. 7,114,834 discloses a light comprising a housing, a plurality of LED lights coupled in an array inside of the housing, and a reflective protrusion coupled to the housing wherein the reflective protrusion is for reflecting light from the LED lights out of the housing. The housing can be of any shape such as tubular, bowl shaped, or having an oval cross section. In addition, the reflective protrusion can be of any shape such as dome shaped or pyramidal shaped. The circuitry relating to this LED light array can include a power source such as a connection to an AC or DC input. If the connection is to an AC input, the device can also include an AC/DC converter coupled to the power source for receiving an input from the AC power source. In this way the LED array receives a consistent flow of DC current that will not result in the LED lights burning out. To prevent this LED array from burning out there is also a current regulator for controlling a current flowing through this LED array.

Robertson et al., U.S. Pat. No. 7,114,830 discloses that the present invention provides several embodiments of an elongate hollow tubular or solid rod lighting device including a plurality of LEDs therewith and appropriate electrical componentry, and serving as a direct replacement for a conventional fluorescent light tube in a conventional fluorescent lighting fixture. The present lighting device includes appropriate connector pins extending from each end thereof, enabling the device to be installed in a conventional fluorescent lighting fixture with no modification to the fixture. The light may include appropriate electrical componentry such as a step-down transformer to provide the required voltage for the LEDs, either integrally within the light, incorporated in an end cap thereof, or installed separately therefrom in the fixture, as desired. The light may be colored or tinted as desired by the use of LEDs providing the desired color output, and/or by installing a tinted sleeve over the tube or rod as desired.

Lodhie et al., U.S. Pat. No. 6,997,576 discloses that an LED lamp has a substantially planar circuit board having two opposed sides, and a plurality of light-emitting diodes (LEDs) grouped to form two LED arrays. The LEDs of one of the two LED arrays are mounted along opposite edges of one of the sides of the circuit board. The LEDs of the other LED array are mounted along opposite edges of the other side of the circuit board.

Cross et al., U.S. Pat. No. 6,936,968 discloses that an LED light tube for replacement for fluorescent light tubes includes an elongated cylindrical transparent envelope, a base cap at each end of the envelope, and at least one LED device in electrical communication with the base cap. The LED light tube is adapted for use in troffer light fixtures.

Robertson et al., U.S. Pat. No. 6,860,628 discloses that the present invention provides several embodiments of an elongate hollow tubular or solid rod lighting device including a plurality of LEDs therewith and appropriate electrical componentry, and serving as a direct replacement for a conventional fluorescent light tube in a conventional fluorescent lighting fixture. The present lighting device includes appropriate connector pins extending from each end thereof, enabling the device to be installed in a conventional fluorescent lighting fixture with no modification to the fixture. The light may include appropriate electrical componentry such as a step-down transformer to provide the required voltage for the LEDs, either integrally within the light, incorporated in an end cap thereof, or installed separately therefrom in the fixture, as desired. The light may be colored or tinted as desired by the use of LEDs providing the desired color output, and/or by installing a tinted sleeve over the tube or rod as desired.

Iwasa et al., U.S. Pat. No. 6,583,550 discloses that a fluorescent tube is constituted by a fluorescent tubular body having a transparent glass tube coated with a fluorescent layer containing a fluorescent material on its inner surface, and an ultraviolet LED substrate inserted in the fluorescent tubular body and having an equal length to the fluorescent tubular body. The ultraviolet LED substrate has twenty-four ultraviolet light emitting devices each having a long life, and the left end of the ultraviolet LED substrate is connected with lead wires through which electric power is supplied. Accordingly, when ultraviolet rays are emitted from the twenty-four ultraviolet light emitting devices, the fluorescent layer emits light in its own fluorescent color, the fluorescent tubular body as a whole emits light and the surroundings are illuminated with the light. Hence, the fluorescent tube can be used for illumination. Alternatively, the fluorescent tubular body may be formed by a transparent silicone rubber which can be bent into any desired shape.

Deakin, GB 2447257 discloses that a one piece assembly retro-fit replacement lamp for fluorescent light fitting device with external Light Emitting Diode (LED) light panel and an internally housed LED power supply unit designed to allow the assembly to be installed into an existing fluorescent light fitting to replace the existing light source with a LED light source. The one piece assembly with an internally housed LED power supply when installed in an existing fluorescent light fitting uses the incoming mains power but isolates and makes redundant the fluorescent tube power supply and supplies the correct power output to operate the LED light panel. The assembly can be retro fitted in existing fluorescent light fitting of any length and eliminates the need to replace the existing light fitting when a more efficient and longer life light source is required.

The related art described above discloses LED lighting tubes and also such tubes for replacement of standard fluorescent lamps. However, the prior art fails to disclose a tube with a removable and reusable end cap. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A replacement for the standard fluorescent lamp tube has a plurality of LED devices mounted on a circuit board. The enclosure within which the circuit board is held has a clear or frosted lens mounted on a heat sink. The lens and heat sink each are arcuately shaped and together form a circular tube. A power converter is mounted below the circuit board and transfers its heat to the heat sink. A pair of pins mounted on the power converter extend beyond one end of the tube. An end cap has means for snapping onto and off the end of the tube and has clearance holes for the pins to protrude through and extend beyond so as to be fitting into mechanical and electrical contact with a standard lamp mounting fixture.

A primary objective inherent in the above described apparatus and method of use is to provide advantages not taught by the prior art.

Another objective is to provide a means for gaining access to a lamp fixture's interior for services it components.

A further objective is to provide an end cap on a tubular lighting fixture wherein the end cap has clearance holes for receiving contact pins of the fixture so that the end cap may be easily removed from the fixture and replaced on the fixture.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is a best mode embodiment of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
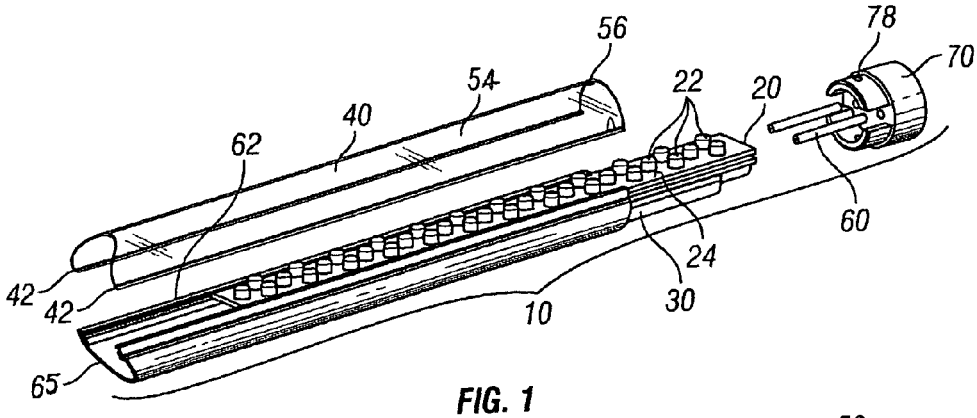
FIG. 1 is a perspective view of the presently described invention with the elements shown separated for clarity.
Figure 2:
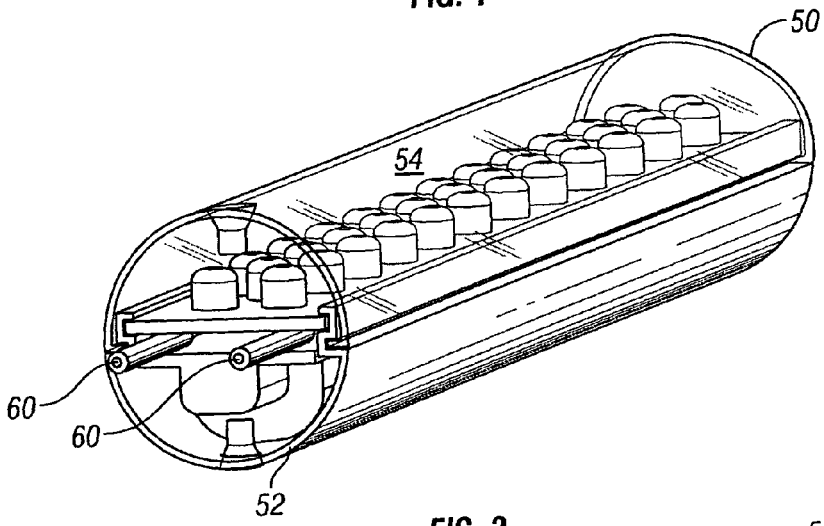
FIG. 2 is a top perspective view thereof as assembled minus an end cap thereof.

Shown in the separated view of FIG. 1 is a light emitting diode (LED) lighting tube assembly 10 made up of individual parts including a circuit board 20 with a plurality of LEDs 22 mounted on its top surface 24. The LEDs 22 are components of an electrical circuit which includes a power converter 30, of any common and well known type, located adjacent to a bottom side 26 (FIG. 6) of the circuit board 20, the power converter 30 interconnected with the circuit board 20 for providing direct current to the LEDs 22.

Figure 6:
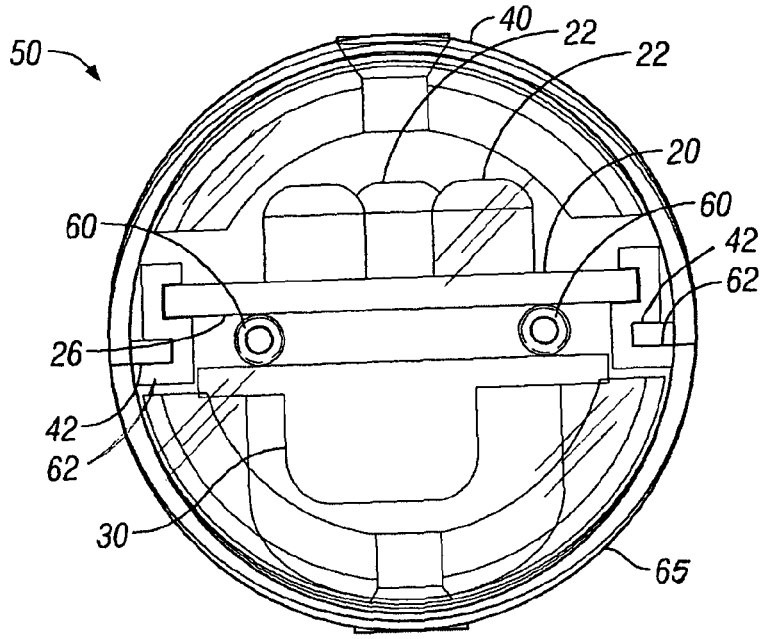
FIG. 6 is an enlarged end view thereof with the end cap shown transparent.

The circuit board 20 and power converter 30 are fitted within a tubular enclosure 50 as best shown in FIG. 6. The tubular enclosure 50 includes a clear or translucent arcuate lens 40 which covers the LEDs 22 on the circuit board 20 so that their illumination is able to pass out of assembly 10 providing room lighting and such. The arcuate lens 40 has a first pair of spaced apart edges 42 which extend longitudinally along the lens 40, as shown in FIG. 1. Completing the tubular enclosure 50 is an arcuate metal heat sink 65 which has a second pair of spaced apart edges 62. The arcuate lens 40 and the arcuate heat sink 65 abut along the first 42 and second 62 pairs of spaced apart edges so that together they form a circular tubular shape with open ends. Heat sink 65 further has S-shaped portions contiguous with each of the second edges 62, and the circuit board 20 is fitted into and engaged frictionally with the S-shaped portions so as to be held securely in place.

Figure 7:
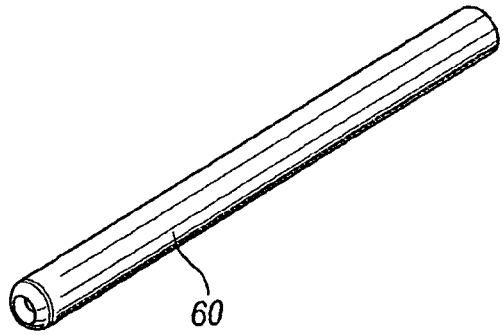
FIG. 7 is a perspective view of an electrical connector pin thereof.
Figure 8:
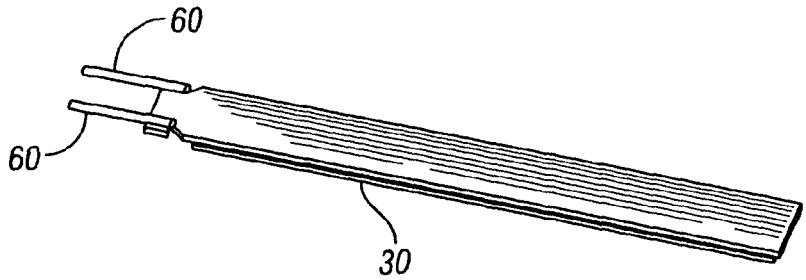
FIG. 8 is a perspective view of a circuit board of a power converter thereof showing the relationship between the connector pins and the power converter.

A pair of metal contact pins 60 (FIG. 7) are engaged with the power converter 30 (FIG. 8), the pins 60 extending longitudinally beyond one end 52 of the tubular enclosure 50 as shown in FIGS. 2-5.

Figure 9:
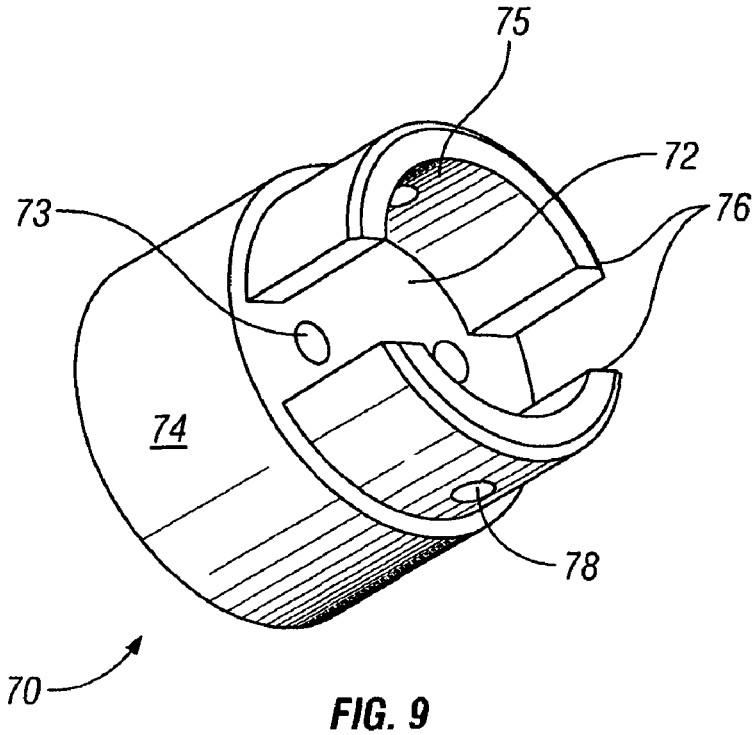
FIG. 9 is a front perspective view of the end cap thereof showing a split flange.
Figure 10:
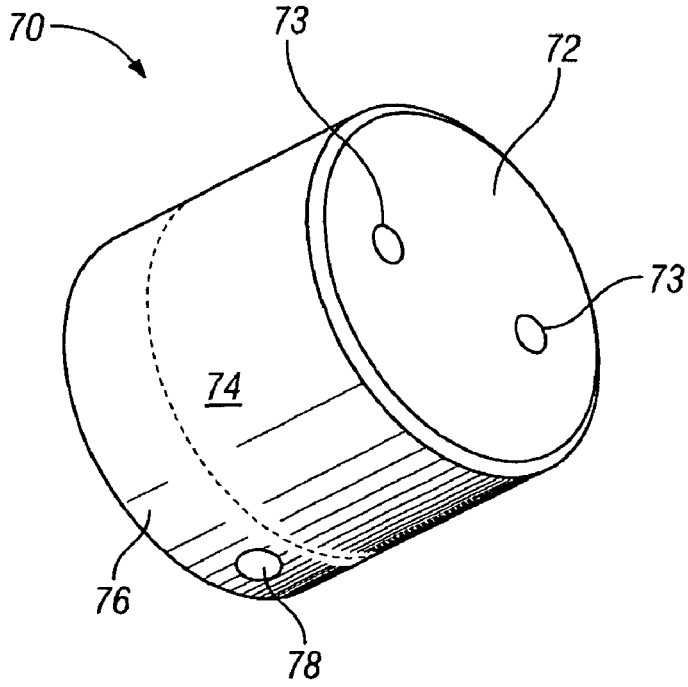
FIG. 10 is a rear perspective view of the end cap showing a continuous flange.

Referring now to FIGS. 9 and 10, the lighting tube assembly 10 further provides an end cap 70 which has a solid body 72 with an outer circular surface 74 and a tubular flange 76 coincident with (FIG. 10), or slightly non-coincident with (FIG. 9), the outer circular surface 74. The tubular flange 76 may be split as shown in FIG. 9, or continuous as shown in FIGS. 10 and 3-5. When mounted on the end 52 (FIG. 2) of the tubular enclosure 50 an inner surface 75 of the tubular flange 76 is in frictional contact with an outer surface 54 of the tubular enclosure 50. Preferably, the tubular flange 76 has at least two lateral through holes 78 located in opposing positions, and the tubular enclosure 50 has upsets 56 (FIG. 1) extending radially outward from the outer surface 54, the upsets 56 are in positions for partially engaging the holes 78 so that the end cap 70 is able to be snapped onto and removably secured on the tubular enclosure 50.

Figure 3:
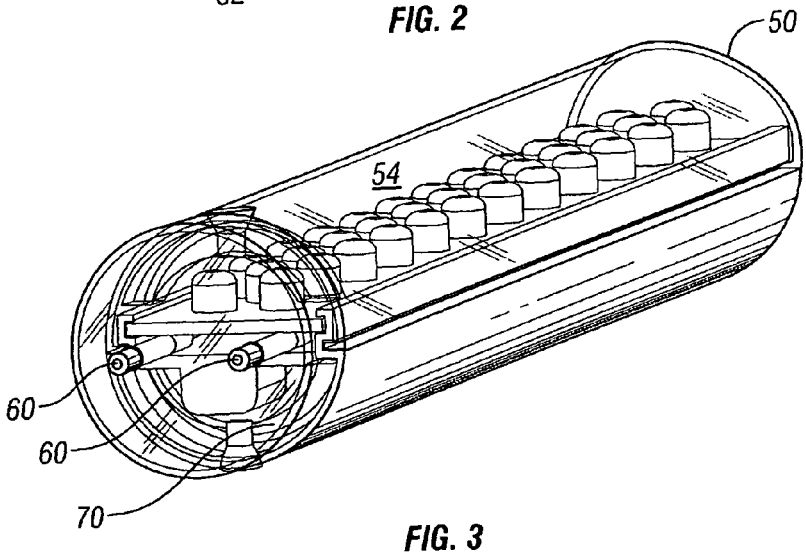
FIG. 3 is a top perspective view thereof as assembled with the end cap shown mounted in place and shown transparent for improved understanding.
Figure 4:
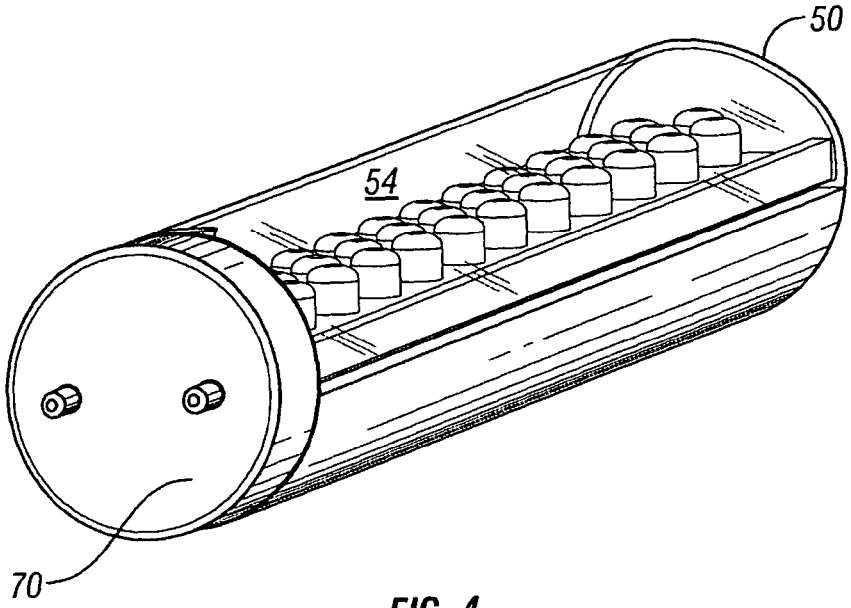
FIG. 4 is the same view as FIG. 3 but with the end cap shown opaque.
Figure 5:
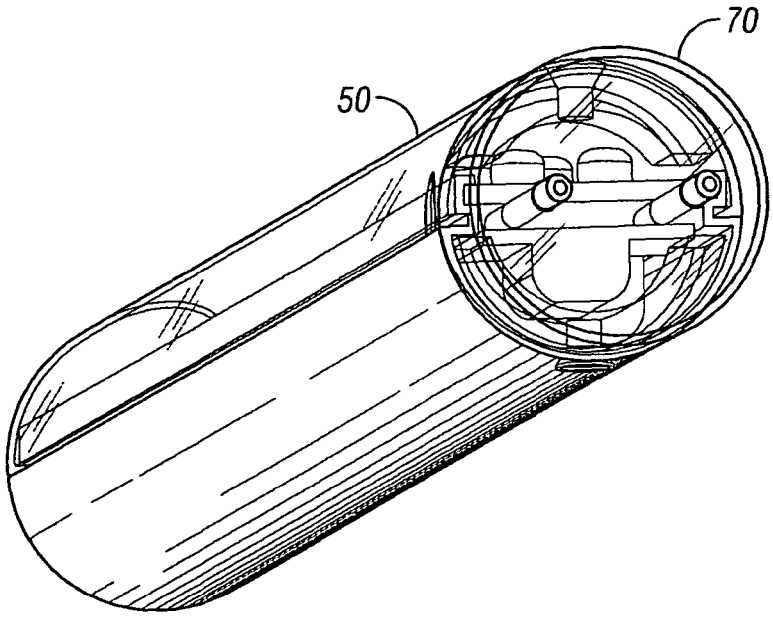
FIG. 5 is a bottom perspective view thereof with the end cap shown transparent.

The solid body 72 of end cap 70 has two through longitudinally aligned holes 73 located in positions for accepting contact pins 60 which extend through holes 73 of the solid body 72 and extend longitudinally beyond end cap 70 as shown in FIGS. 3-5 for engaging spring electrodes of a standard fluorescent lamp mounting fixture. For mounting in such a fixture, end caps are mounted on both ends of tubular enclosure 50 although end cap 70 need be used only on the one end 52, while the opposite end of the tubular enclosure 50 will have a standard end cap (not shown) of the type found on common fluorescent lamps. Holes 73 have a larger diameter than the outside diameter of contact pins 60 so that end cap 70 is able to be snapped off of tubular enclosure 50 without disturbing pins 60 or the power converter 40. This provides the significant advantage of being able to gain access to the circuit board 20 and the power converter 30 for servicing.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A longitudinally extensive lighting assembly, comprising:

an electrical circuit having a plurality of light emitting diodes;

a power converter interconnected with the electrical circuit for directing direct current to the light emitting diodes;

a lens covering the light emitting diodes, the lens having a semi-circular shape and a first pair of longitudinally directed edges;

a heat sink having a semi-circular shape and a second pair of longitudinally directed edges;

the first and second pairs of edges mutually engaged thereby forming a rigid, longitudinally directed circular tube with two opposing open ends;

a pair of electrically conductive contact pins of the power converter extending longitudinally beyond one end of the tubular enclosure; and an end cap mounted on the one end of the tubular enclosure, the end cap having a circular flange split into two opposing portions, the portions engaged in strained opposition around the tubular enclosure at one of the open ends.

2. The lighting assembly of claim 1 wherein the circular flange has a pair of opposing circular holes therein, and the tubular enclosure having outwardly directed upsets engaged within the circular holes thereby securing the end cap on the tubular enclosure.

3. An end cap for a tubular lighting assembly, the end cap comprising a circular body having a pair of longitudinal clearance holes there through for accepting contact pins of the lighting assembly, and a circular flange split into two directly opposing portions for diametrical gripping an outside surface of the lighting assembly, the circular flange having a pair of opposing radially-directed circular holes therein for receiving outwardly-directed upsets of the lighting assembly, the circular flange and radially directed holes for securing the end cap to the lighting assembly.

* * * * *